US005980335A

United States Patent [19]

Barbieri et al.

[11] Patent Number: 5,980,335

[45] Date of Patent: Nov. 9, 1999

[54] ELECTRICAL TERMINAL

[75] Inventors: Silvio Barbieri, Padova; Roberto Martucci, Montegrotto Terme Padova, both of Italy

[73] Assignee: Molex Incorporated, Lisle, Ill.

[21] Appl. No.: 09/049,489

[22] Filed: Mar. 27, 1998

[51] Int. Cl.[6] ..... H01R 11/22

[52] U.S. Cl. ..... 439/824; 439/887

[58] Field of Search ..... 439/891, 887, 439/700, 824, 289

[56] References Cited

U.S. PATENT DOCUMENTS

| | | | |
|---|---|---|---|
| 4,413,874 | 11/1983 | Williams | 439/824 |
| 4,778,404 | 10/1988 | Pass | 439/700 |
| 5,151,643 | 9/1992 | Emmert et al. | 320/2 |
| 5,350,322 | 9/1994 | Kondo | 439/862 |
| 5,540,599 | 7/1996 | Bishop | 439/289 |
| 5,664,973 | 9/1997 | Emmert et al. | 439/862 |
| 5,713,765 | 2/1998 | Nugent | 439/700 |

*Primary Examiner*—Steven L. Stephan
*Assistant Examiner*—J. F. Duverne
*Attorney, Agent, or Firm*—Stephen Z. Weiss

[57] ABSTRACT

A one-piece electrical terminal (10) includes a strip (44) of conductive metal material having a contact portion (14) and a terminating portion (16). The contact portion (14) is fabricated of a relatively soft metal drawn into a shaped contact (18). The terminating portion (16) is integral with the contact portion (14) and is fabricated of a relatively hard tempered metal formed into a spring arm (16) supporting the contact (18).

23 Claims, 4 Drawing Sheets

ELECTRICAL TERMINAL

FIELD OF THE INVENTION

This invention generally relates to the art of electrical connectors and, particularly, to a one-piece electrical terminal.

BACKGROUND OF THE INVENTION

Generally, electrical connectors include some form of dielectric housing or chassis for mounting one or more conductive electrical terminals. Typically, the terminals have a contact end and a terminating end. The terminating end is electrically terminated to conductors with which the connector is electrically associated. The contact end is adapted for engaging a contact of an appropriate mating connector or other mating electronic device. The terminating end of the terminal(s) can be terminated to a discrete electrical wire or to circuit traces on a printed circuit board, for instance.

In some connector applications, it is desirable or necessary to spring-load at least the contact end or portion of the terminal(s). This can be accomplished by fabricating a portion of the terminal with hard or spring tempered metal and then forming the terminal portion into a spring configuration. Another approach is to fabricate the terminal as a multi-part component wherein the spring is a separate part of the terminal assembly. An example of the latter type of terminal is a "pogo-pin" terminal which typically is fabricated of three parts, namely a housing for a separate spring which biases a separate contact end of the terminal. Such multi-part terminals create problems in both the cost of the assembly as well as its reliability.

In other connector applications, terminals are used in sealed environments, such as in battery connector applications. In other words, a spring-loaded terminal contact may project through a sealing grommet and move relative thereto while maintaining a seal with the grommet. In such applications, the contact end or portion of the terminal often is a closed-ended or dome-shaped structure which can be readily sealed about the periphery thereof. A multi-part "pogo-pin" terminal assembly often is used in such applications notwithstanding the problems mentioned above.

The present invention is directed to solving the various problems discussed above by a one-piece electrical terminal which is both spring loaded and includes an easily sealable contact end, such as a dome-shaped end.

SUMMARY OF THE INVENTION

An object, therefore, of the invention is to provide a new and improved, one-piece electrical terminal of the character described.

In the exemplary embodiment of the invention, the terminal includes a strip of conductive metal material having a short contact portion and a long terminating portion. The short contact portion is fabricated of a relatively soft metal which is drawn into a shaped contact. The long terminating portion is integral with the contact portion and is fabricated of a relatively hard tempered metal which is formed into a spring arm supporting the contact.

As disclosed herein, the contact portion of the one-piece terminal is deep drawn into a closed-ended cylindrical contact configuration. The terminating portion is formed into a generally S-shaped spring arm. The distal end of the terminating portion can be generally planar for surface-mounting on a printed circuit board.

In one embodiment of the invention, the conductive metal strip is an integral bi-metal strip, with the short contact portion being of a relatively soft first metal integrally joined to the long terminating portion which is of a relatively hard second metal. For instance, the first portion may be fabricated of a copper material and the second portion may be fabricated of a phosphorous-bronze material.

In another embodiment, the conductive metal strip is fabricated of a singular metal material with the terminating portion being selectively strain hardened. For example, the strip may be fabricated of copper or brass.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
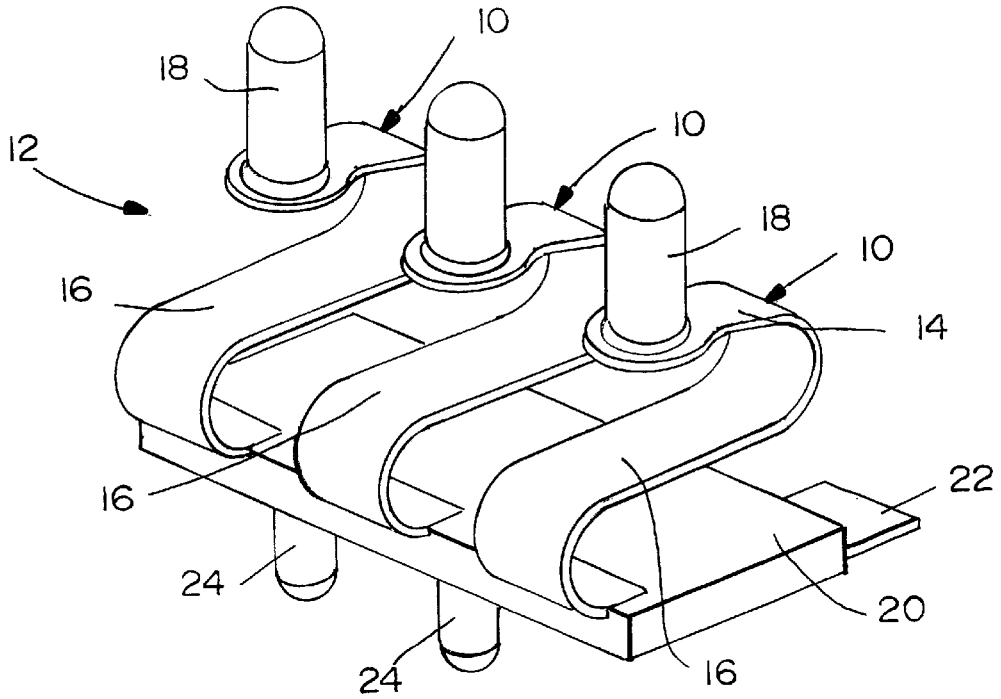
FIG. 1 is a perspective view of a terminal module including a plurality of one-piece electrical terminals according to the invention.
Figure 2:
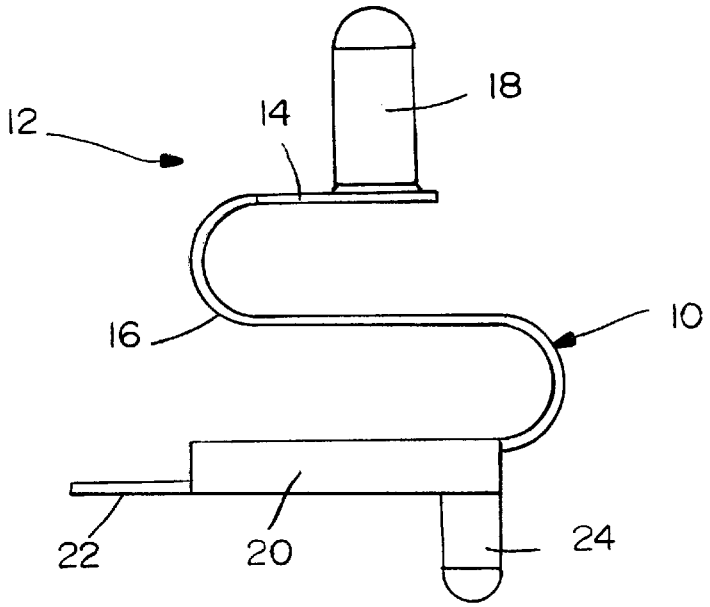
FIG. 2 is a side elevational view of the terminal module.
Figure 3:
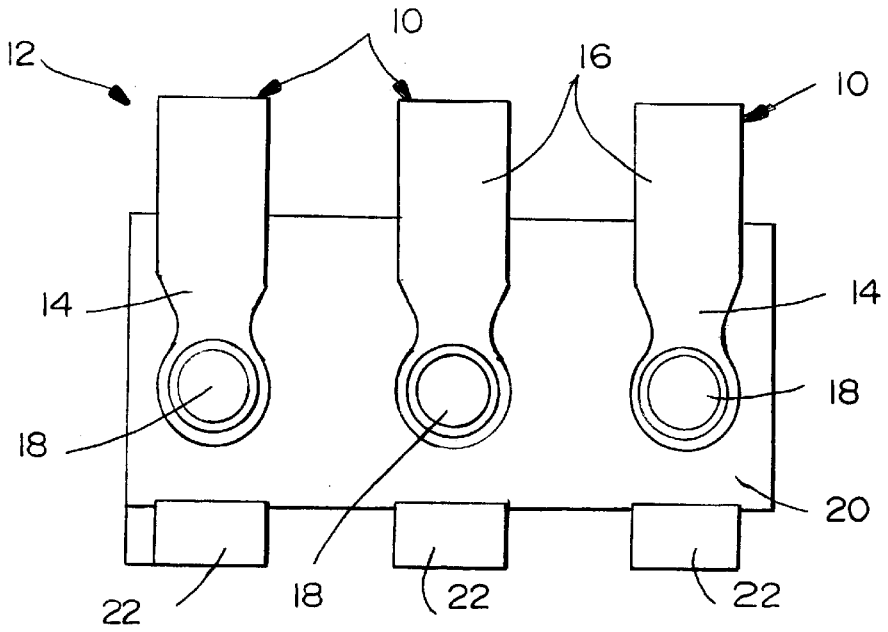
FIG. 3 is a top plan view of the terminal module.
Figure 4:
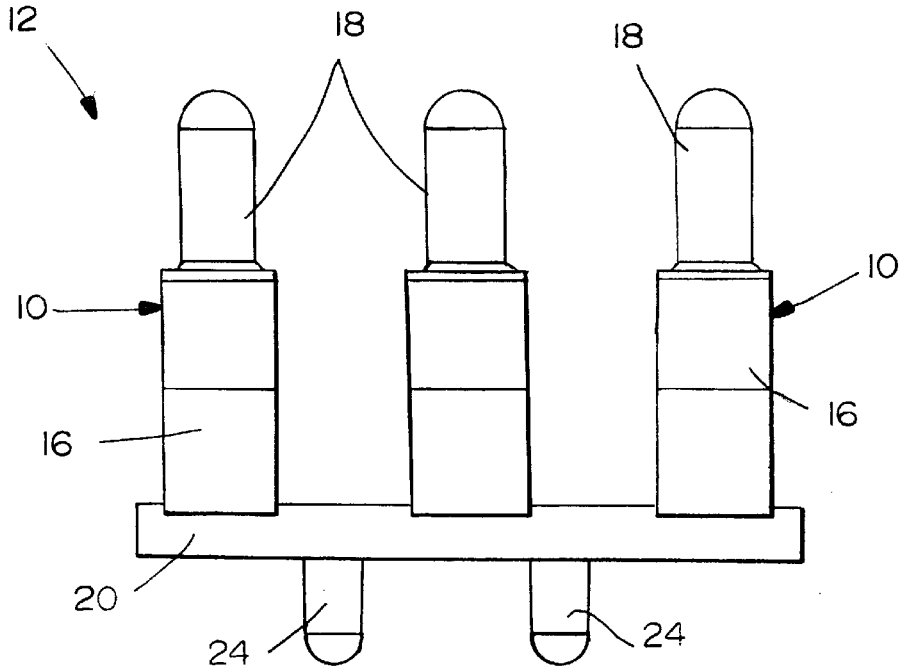
FIG. 4 is a front elevational view of the terminal module.

Referring to the drawings in greater detail, and first to FIGS. 1–4, the invention is embodied in a one-piece electrical terminal, generally designated 10, which is shown in the drawings as one of three terminals of a terminal module, generally designated 12. Each terminal is fabricated of a strip of conductive metal material having a short contact portion 14 and a long terminating portion 16. The short contact portion is fabricated of a relatively soft metal, as described hereinafter, drawn into a closed-ended cylindrical contact 18. Long terminating portion 16 is integral with contact portion 14 and is fabricated of a relatively hard tempered metal, as described hereinafter, formed into a generally S-shaped spring arm as shown clearly in FIGS. 1 and 2. Whereas one end of the S-shaped spring arm 16 is integral with contact 18, the opposite end of the S-shaped spring arms of all of the terminals are embedded in a dielectric base 20. The dielectric base may be of plastic material and overmolded about the ends of the S-shaped spring arms of the terminals. A distal end 22 of each S-shaped spring arm 16 of each terminal 10 is generally planar for surface-mounting on a printed circuit board (not shown). To that end, overmolded dielectric base 20 includes a plurality of integrally molded mounting posts 24 depending from the underside thereof for insertion into appropriate mounting holes in the printed circuit board.

Figure 5:
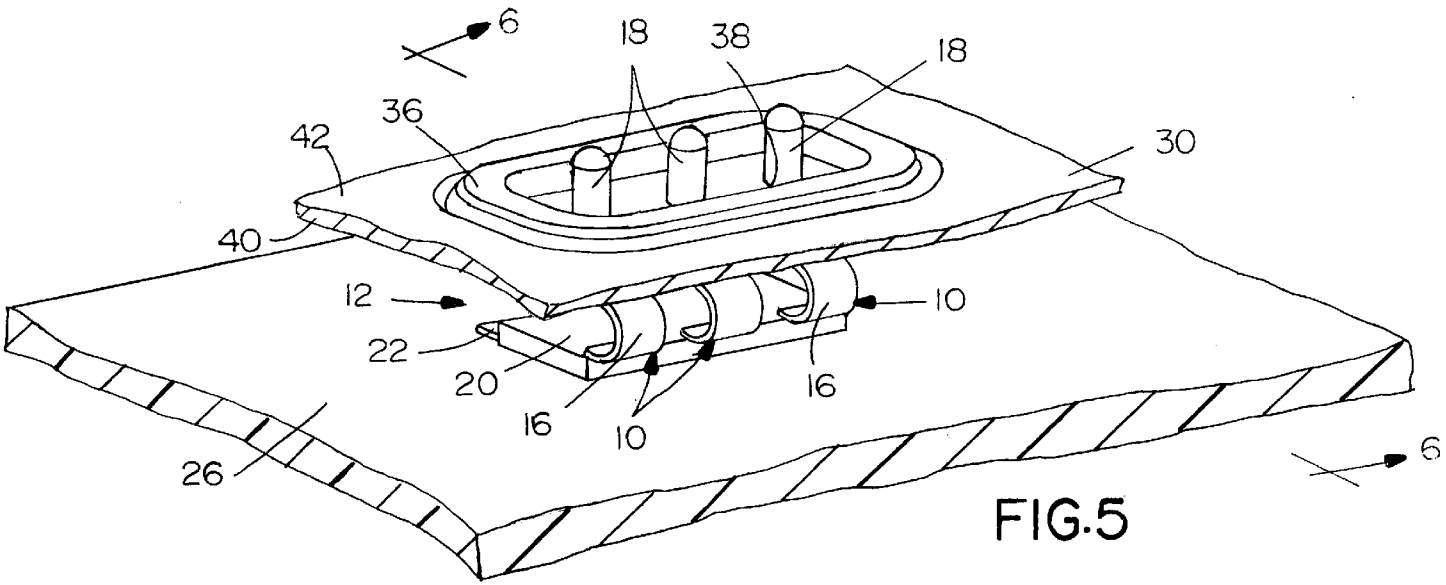
FIG. 5 shows the terminal module mounted in a connector application.
Figure 6:
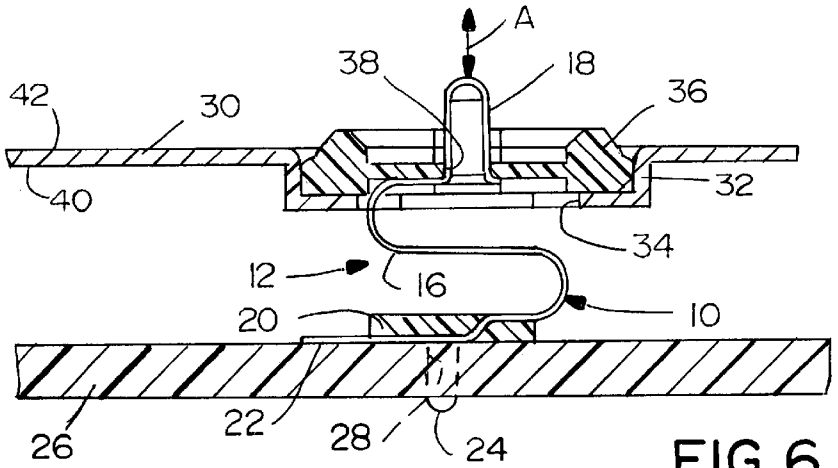
FIG. 6 is a vertical section taken generally along line 6—6 of FIG. 5.

Referring to FIGS. 5 and 6, terminal module 12, including the one-piece terminals 10, is shown mounted on a printed circuit board 26. FIG. 6 shows distal ends 22 of the terminals surface mounted to a top surface 26*a* of the circuit board, with mounting posts 24 projecting through mounting holes 28 in the board.

In the connector application of FIGS. 5 and 6, a chassis wall 30 is spaced from but fixed relative to printed circuit board 26. The chassis wall has a socket 32 with a through opening 34. The closed-ended cylindrical contacts 18, along with the top of the S-shaped spring arms 16 of terminals 10 project upwardly through openings 34 as best seen in FIG. 6. An elastomeric sealing grommet 36 is press fit within socket 32 of chassis wall 30. The grommet has three holes 38 through which cylindrical contacts 18 of the terminals project. Therefore, the grommet seals with the cylindrical contacts within the peripheries of holes 38, and the grommet seals with the interior of socket 32 about the periphery of the grommet. Assuming that chassis wall 30 forms an enclosure for the connector application, the grommet seals the interior 40 of the enclosure from the exterior thereof. With S-shaped spring arms 16 functioning to spring-load cylindrical contacts 18, the contacts can move in the direction of double-headed "A" (FIG. 6) within holes 38 in sealing grommet 36. The connector application shown in FIGS. 5 and 6 could be a battery connector assembly wherein the outside 42 of chassis wall 30 forms the battery side of the connector assembly, and terminals 10 form electrical interconnections between the battery terminals and circuit traces on printed circuit board 26.

Figure 7:
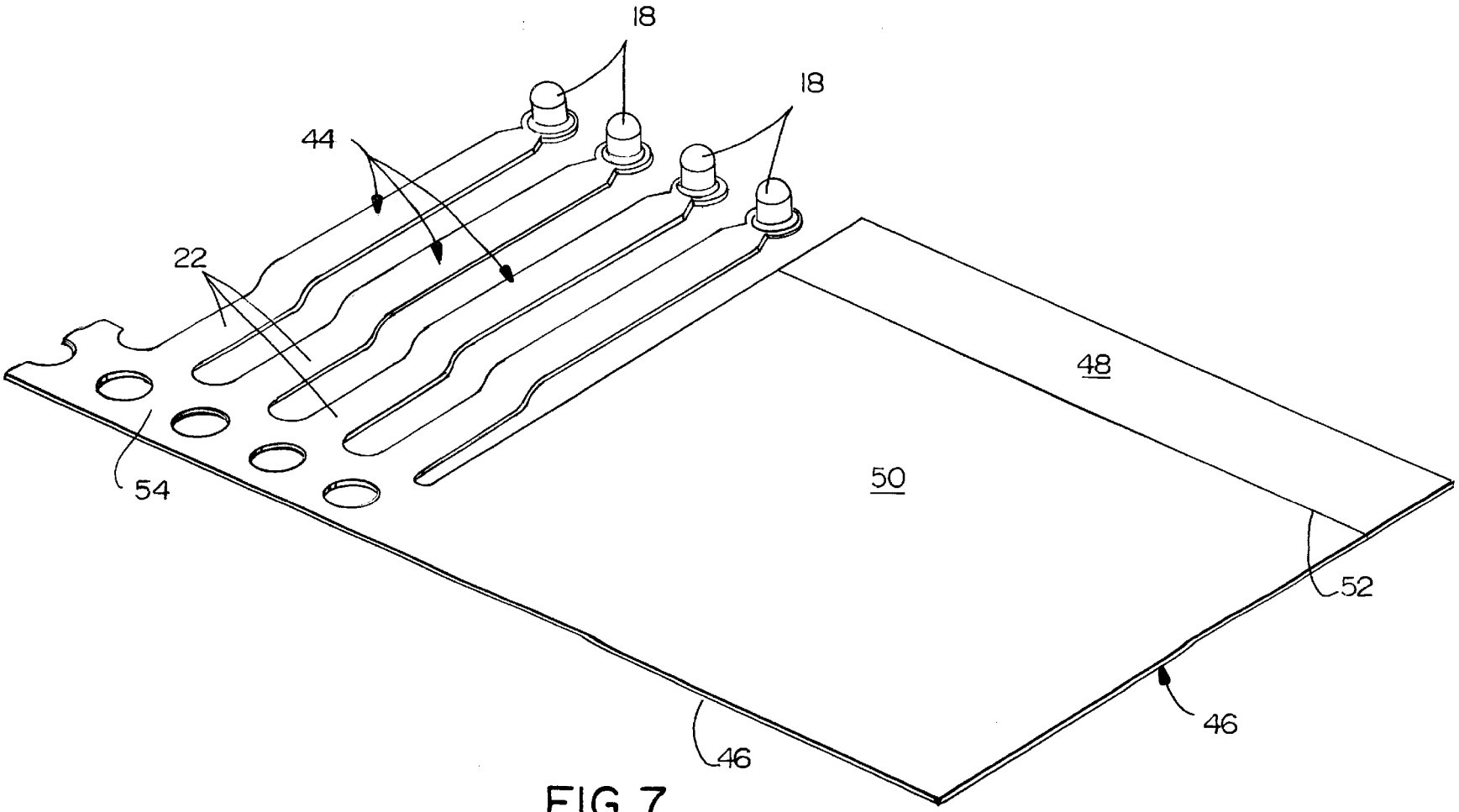
FIG. 7 shows a plurality of the terminals during fabrication from a length of metal material.

FIG. 7 illustrates how terminals 10 (FIGS. 1–6) are fabricated from a plurality of strips, generally designated 44, stamped out of a continuous sheet of metal material, generally designated 46. The sheet can be a bi-metal sheet or a singular metal sheet. In either alternative, the sheet has a first portion 48 fabricated of a relatively soft material which can be deep drawn to form closed-ended cylindrical contacts 18. A second portion 50 of sheet 46 is fabricated of a relatively hard tempered material which can be formed into S-shaped spring arms 16. The two portions 48 and 50 are integrally joined, as at 52.

With continuous sheet 46 fabricated of a bi-metal material, relatively soft first portion 48 can be fabricated of a copper material, and relatively hard second portion 50 can be fabricated of a phosphorus-bronze material, for instance. The two different metal portions are integrally joined by a laser weld at 52. The copper material of first portion 48 can be drawn into the closed-ended cylindrical contact configuration of contacts 18. The harder phosphorus-bronze material of second portion 50 can be formed into the S-shaped spring arms 16.

As stated above, sheet 46 also can be fabricated of a singular metal material such as of copper, brass or the like. With the singular material, second portion 50 of strip 46 is selectively treated by a strain hardening process so that the sheet is spring-hardened from edge 46*a* to line 52, leaving portion 48 in a softer state for drawing into contacts 18.

With either a bi-metal sheet 46 or a singular metal sheet 46, the sheet is run through a series of stamping stations wherein strips 44 are stamped and contacts 18 are drawn, leaving distal ends 22 of the terminals still attached to a carrier strip 54 of the sheet material. The strips then are fed to forming stations whereat the S-shaped spring arms 16 are formed. When the terminals are severed from carrier strip 54, the terminals will have drawn contacts 18 and terminating distal ends 22 at opposite ends of the S-shaped arms. If the terminals are to be used in a terminal module, such as module 12 described above, three or more of the terminals may remain attached to carrier strip 54 while the terminals are fed to a molding station for overmolding dielectric base 20, whereafter carrier strip 54 can be removed.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A one-piece electrical terminal, comprising:

a strip of conductive metal material having a short contact portion and a long terminating portion, the short contact portion being fabricated of a relatively soft metal drawn into a shaped contact, and the long terminating portion being integral with the short contact portion and being fabricated of a relatively hard tempered metal formed into a spring arm supporting the contact.

2. The one-piece electrical terminal of claim 1 wherein said contact portion is drawn into a closed-ended cylindrical contact configuration.

3. The one-piece electrical terminal of claim 1 wherein said terminating portion is formed into a generally S-shaped spring arm.

4. The one-piece electrical terminal of claim 1 wherein a distal end of said terminating portion is generally planar for surface-mounting on a printed circuit board.

5. The one-piece electrical terminal of claim 1 wherein said strip is an integral bi-metal strip with said short contact portion being of a relatively soft first metal integrally joined to the long terminating portion which is of a relatively hard second metal.

6. The one-piece electrical terminal of claim 1 wherein said strip is fabricated of a singular metal material with the terminating portion being selectively strain hardened.

7. The one-piece electrical terminal of claim 6 wherein said strip is fabricated of a copper material.

8. The one-piece electrical terminal of claim 6 wherein said strip is fabricated of a brass material.

9. A one-piece electrical terminal, comprising:

an elongated strip of conductive metal material having a short contact end and a long terminating end, the short contact end being fabricated of a relatively soft metal drawn into a contact having a close-ended cylindrical configuration, and the long terminating end being integral with the contact end and being fabricated of a relatively hard tempered metal formed into a generally S-shaped spring arm supporting the contact.

10. The one-piece electrical terminal of claim 9 wherein a distal end of said terminating end is generally planar for surface-mounting on a printed circuit board.

11. The one-piece electrical terminal of claim 9 wherein said strip is an integral bi-metal strip with said short contact end being of a relatively soft first metal integrally joined to the long terminating end which is of a relatively hard second metal.

12. The one-piece electrical terminal of claim 9 wherein said strip is fabricated of a singular metal material with the terminating end being selectively strain hardened.

13. The one-piece electrical terminal of claim 12 wherein said strip is fabricated of a copper material.

14. The one-piece electrical terminal of claim 12 wherein said strip is fabricated of a brass material.

15. The one-piece electrical terminal of claim 1 wherein said contact end is fabricated of a copper material and said terminating end is fabricated of a phosphorus-bronze material.

16. A one-piece electrical terminal, comprising:

a conductive metal structure having first and second portions, the first portion being fabricated of a relatively soft material drawn into a given shape, and the second portion being fabricated of a relatively hard tempered material formed into a spring configuration.

17. The one-piece electrical terminal of claim 16 wherein said first portion is drawn into a closed-ended cylindrical shape.

18. The one-piece electrical terminal of claim 16 wherein said second portion is formed into a generally S-shape.

19. The one-piece electrical terminal of claim 16 wherein said structure is fabricated of a singular metal material with the second portion being selectively strain hardened.

20. The one-piece electrical terminal of claim 19 wherein said structure is fabricated of copper material.

21. The one-piece electrical terminal of claim 19 wherein said structure is fabricated of brass material.

22. The one-piece electrical terminal of claim 19 wherein said structure is an integral bi-metal structure with said first portion being of a relatively soft first metal integrally joined to the second portion which is of a relatively hard second metal.

23. The one-piece electrical terminal of claim 22 wherein said first portion is fabricated of a copper material and said second portion is fabricated of a phosphorus-bronze material.

* * * * *